United States Patent [19]

Worley

[11] 4,448,006

[45] May 15, 1984

[54] GRID CEILING STRUCTURE AND METHOD OF CONVERTING

[75] Inventor: Robert F. Worley, Bay Village, Ohio

[73] Assignee: Donn Incorporated, Westlake, Ohio

[21] Appl. No.: 267,731

[22] Filed: May 28, 1981

[51] Int. Cl.[3] ..... E04B 5/55

[52] U.S. Cl. ..... 52/488; 52/489; 52/747; 52/762

[58] Field of Search ..... 52/762, 489, 665, 668, 52/669, 474, DIG. 8, 717, 484, 714, 747, 741; 248/228, 342, 343, 317

[56] References Cited

U.S. PATENT DOCUMENTS

| | | | |
|---|---|---|---|
| 3,182,773 | 5/1965 | Laaksonew | 52/762 |
| 3,387,872 | 6/1968 | Lovullo | 52/DIG. 8 |
| 3,436,108 | 4/1969 | Van Buren | 52/489 |
| 3,589,660 | 6/1971 | Dunckel | 52/714 |
| 3,645,051 | 2/1972 | Kolesar | 52/484 |
| 3,685,235 | 8/1972 | Lang | 52/488 |
| 4,157,000 | 6/1979 | Sutter | 52/489 |
| 4,270,327 | 6/1981 | Van Leeuwen | 52/762 |

FOREIGN PATENT DOCUMENTS

| | | | |
|---|---|---|---|
| 99829 | 12/1964 | Denmark | 52/762 |
| 1235552 | 3/1967 | Fed. Rep. of Germany | 52/489 |
| 2241615 | 3/1974 | Fed. Rep. of Germany | 52/762 |
| 2007751 | 5/1979 | United Kingdom | 52/714 |

*Primary Examiner*—John E. Murtagh

*Attorney, Agent, or Firm*—Pearne, Gordon, Sessions, McCoy, Granger & Tilberry

[57] ABSTRACT

An elongated bracket used in converting a tee grid/lay-in panel ceiling structure to a linear beam array structure. The bracket has first gripping elements for attachment of the bracket to tees with lay-in panels in place on such tees and second gripping elements for subsequent attachment of linear beams to the bracket.

5 Claims, 7 Drawing Figures

GRID CEILING STRUCTURE AND METHOD OF CONVERTING

BACKGROUND OF THE INVENTION

The invention relates to panel constructions in buildings and like static structures and, more particularly, to suspended ceiling constructions.

PRIOR ART

Suspended ceilings employing a network or grid of elongated tee members and laid in rectangular panels are widely used in a variety of buildings. Essentially, these suspended ceiling structures consist of tee-shaped members or shafts assembled in an open rectangular gridwork and suspended by wires or the like from an overhead superstructure. The rectangular panels are laid in the gridwork and are supported perimetrically by underlying portions of the face flanges of the tees.

Such described ceiling constructions have been widely adopted for many years. Grid spacing and panel size have been largely standardized throughout the industry. Among the reasons for the widespread use of this tee grid/panel ceiling construction is the ease with which it can be installed. Another significant advantage of such systems is the ready accessibility to the area of plenum above the ceiling for maintenance or alteration.

Another type of suspended ceiling system employs a linear array of elongated beams. This style of suspended ceiling is known from U.S. Pat. No. 4,257,206, for example. In this patent, channel-like beams are carried on supports or runners which, in turn, are suspended from an overhead superstructure by wires or the like in essentially the same manner as the more commonly found grid tee/panel ceiling construction referred to above.

The linear beam ceiling affords a rich appearance with a high degree of functionality. The beams can be economically fabricated of steel to provide an incombustible structure. With the beams laterally spaced in a regular pattern they readily accommodate standard light fixtures and air handling equipment. The beams which are of the type which simply snap into position can be unsnapped for removal and access to the overhead plenum or for repair or replacement in case of damage.

SUMMARY OF THE INVENTION

The invention provides a converter bracket for mounting linear beams on conventional tee-grid ceiling structures. The bracket is arranged to be secured to the grid tees while such tees are in an erected state, including the situation where ceiling panels are in place on the tees. This capacity allows the bracket to be installed on existing suspended ceiling structure, thereby avoiding labor costs for removing such existing structure and reducing labor and material costs in a new replacement installation.

In the disclosed embodiment, the bracket is adapted to grip the face flanges of selected ones of the grid tees. The bracket includes integrally formed gripping elements which engage the rearward or upper face of the flanges to effect installation of the bracket without the necessity of using separate fastening elements. The bracket presents depending second gripping elements on its lower face for subsequently attaching a linear array of beams.

The first-mentioned gripping means requires a simple slip-on motion. In the preferred embodiment, the bracket has a center of symmetry about which is disposed the first-mentioned gripping means. With this symmetrical arrangement of the first gripping means, the requisite slip-on assembly motion is accomplished by simply rotating or twisting the bracket in the plane of the tee face flange.

The disclosed converter bracket affords essentially all of the aesthetic qualities and recognized advantages of linear array beam ceiling structures. These advantages include durability and fire safety, especially where the beams are fabricated of sheet metal, favorable acoustic or sound absorbing characteristics, augmented where pre-existing ceiling panels are left in place, adaptability with standard light fixtures, flexibility of lights and air handling, accessibility to the overhead plenum, and maintenance including replaceability of individual damaged panels. The disclosed bracket design, moreover, is economical to manufacture. In certain cases, where inventory can be simplified, for example, the bracket can be utilized with standardized tees to suspend a linear beam ceiling in original construction.

DESCRIPTION OF THE PREFERRED EMBODIMENT

Figure 1:
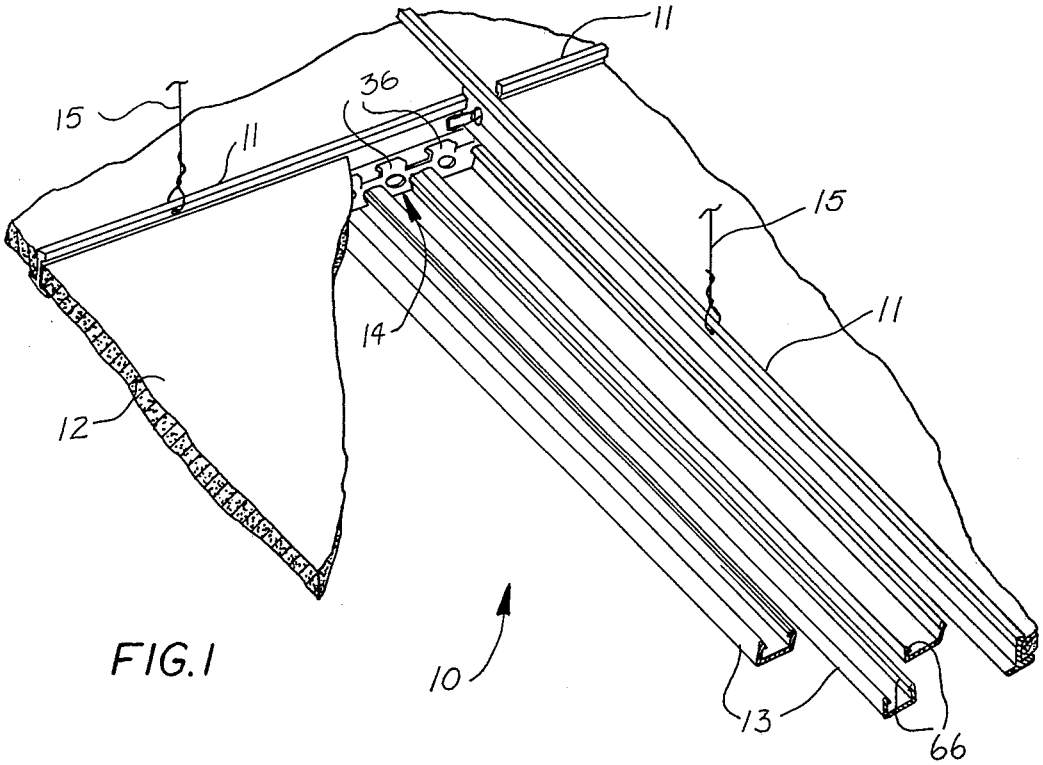
FIG. 1 is a somewhat schematic, overhead perspective, fragmentary view of a linear beam ceiling installed on a grid tee/panel ceiling structure ir accordance with the invention.

Referring now to the drawings and, in particular, to FIG. 1, there is shown a suspended ceiling system 10 in a building. The ceiling system 10 comprises a generally conventional installation of tees 11 in a rectangular grid and cooperating rectangular ceiling panels 12. Under this ceiling system 10 is carried a parallel array of linear beams 13 by converter brackets 14 secured to the tees 11.

The grid-forming 11 tees are of known construction and may be of the type disclosed in U.S. Pat. Nos. 4,161,856 and 4,206,578. As such, the tees 11 are suspended by wires 15 or like hangers from overhead structure of the building or like structure. Each tee 11 has a lower face flange 16, a web 17 and a stiffening bulb 18. In prior conventional use, the lower face 19 of the flange 16 is visible to an observer under the ceiling system 10 and the upper faces 21 on each side of the web 17 support perimetric edges of the panels 12. The panels 12 are assembled on the grid of tees 11 in accordance with conventional practice by laying them into the rectangles formed by the tees.

With qualifications discussed later, it can be assumed that the described grid and panel suspended ceiling construction 10 has been in place for a period of time and that it is desired to change its appearance to that of a linear beam array. In accordance with the invention, this can be accomplished without disassembling the existing ceiling structure 10. As will be understood from the following description, the suspended ceiling system 10 is converted to a linear beam arrangement by attaching the converter or adapter brackets 14 to selected ones of the tees 11 and thereafter attaching beams to such brackets. It is first determined that the existing grid of tees 11 has sufficient strength to support the additional weight of a linear array of beams and adapter brackets.

The disclosed brackets 14 are identical to one another by manufacture. Preferably, the bracket 14 is a painted sheet metal part stamped from strip or sheet steel stock. As illustrated, the bracket 14 is an elongated U-shaped channel having a web 31 and opposed flanges 32. The flanges 32 are in planes obtuse to the plane of the web 31, e.g., at nominal angles of 100°, so that they are slightly divergent to one another in the direction away from the plane of the web.

Figure 4:
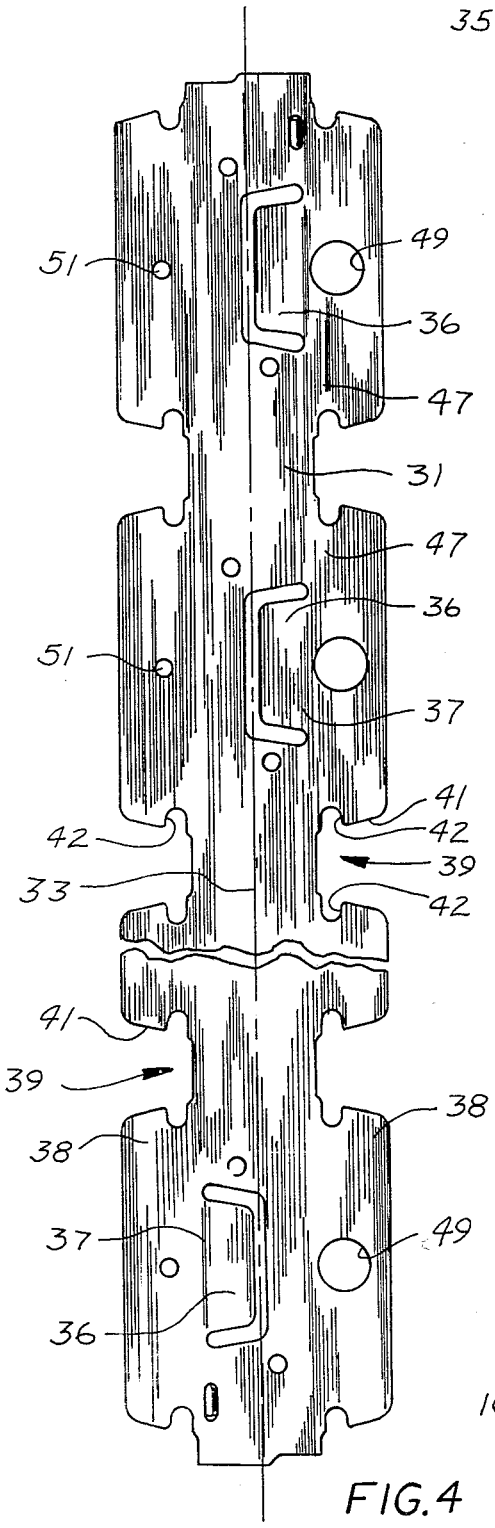
FIG. 4 is a top view of a preform blank from which the connector bracket is formed.
Figure 3:
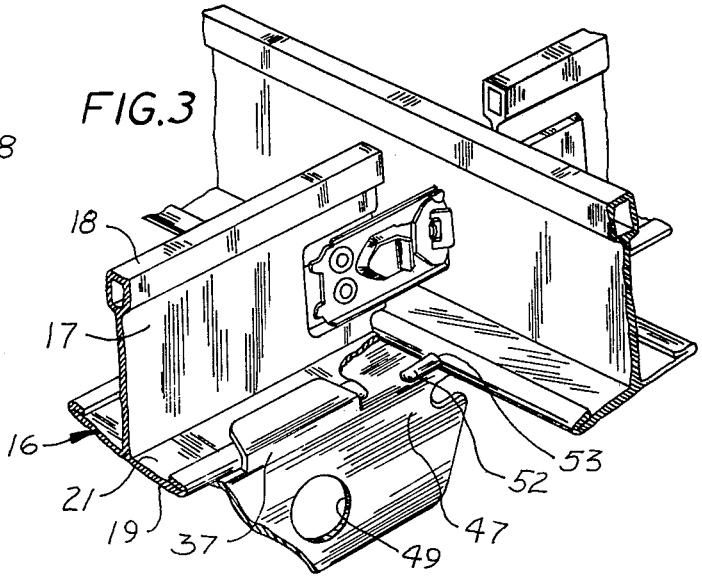
FIG. 3 is an enlarged, fragmentary, perspective view of elements of the converter bracket, the selected tee on which it is mounted, and an intersecting tee.

With reference to FIG. 4, the bracket 14 is shown in an intermediate blank form. For purposes of this description, a longitudinal centerline or axis is indicated at 33 and a transverse centerline or axis is indicated at 34. Along each longitudinal half of the bracket 14, but on opposite sides of the longitudinal axis 33, are a set of three trapezoidally-shaped gripping tabs 36 integrally formed in the body of the bracket. Each set of the tabs 36 has its three edges 48 parallel and slightly spaced from the longitudinal axis 33 when viewed in a plane in or parallel to the web 31. Along their major dimension, the tabs 36 are integrally joined at their bases, indicated at 37, to the remainder of the web 31. It can be seen that the tabs 36 on each half of the bracket 14 are centrally symmetrical with respect to the point formed by the intersection of the longitudinal axis 33 and transverse axis 34.

Along the longitudinal edges of the blank of FIG. 4, in the marginal strips which eventually form the channel flanges 32, are trapezoidal segments 38 remaining after intermediate areas are blanked out at zones generally designated at 39. The blanked out zones 39 are arranged to leave camming edges 41 divergent to one another in the direction of the web 31 on end profiles of the individual segments or tabs 38. The blanked zones 39 are also arranged to form oppositely facing undercut edge gripping areas 42 adjacent the base 47 of the tab 38 where it joins the web.

The tabs 38 are regularly spaced along the length of the bracket 14. For example, where the bracket 14 is nominally 24 inches or two feet long, to complement standard tee grid networks, the center-to-center spacing of the tabs 38 is four inches. Thus, there are pairs of tabs 38, one on each opposed flange 32, at six stations along the bracket 14. In the illustrated case, the tabs or trapezoidal segments 38 are centered, with reference to the longitudinal direction of the bracket 14, with the tabs 36.

Figure 6:
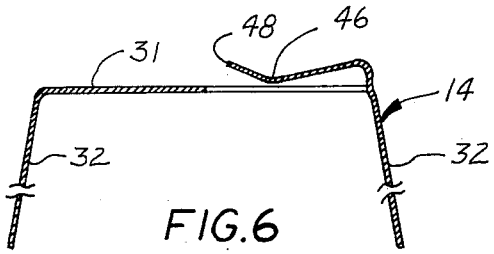
FIG. 6 is a transverse cross-sectional view of the connector bracket.

With reference to FIG. 6, it can be seen that the first-mentioned tabs 36 are stamped out of the plane of the web 31 and are creased on lines 46 parallel to the longitudinal axis 33, giving the tabs 36 a knee configuration when viewed in the longitudinal direction. As a result, the creased area 46 of the tabs 36 is close to the plane of the web 31 while the portion of the tab distal from its connective base 37 flares away from the web 31 with the free tab edge 48 deliberately spaced from the web 31.

As indicated most clearly in FIG. 4, relatively large circular holes 49 are punched through one flange 32 at points centered on the tabs or segments 38. Directly opposite these large holes 49 on the other flange 32 are punched relatively small circular holes 51. The centerlines of the respective holes 49,51 are equally spaced from the longitudinal centerline 33 so that after the blank of FIG. 4 is stamped into the final channel configuration of the bracket 14, these centerlines are coincident.

Figure 2:
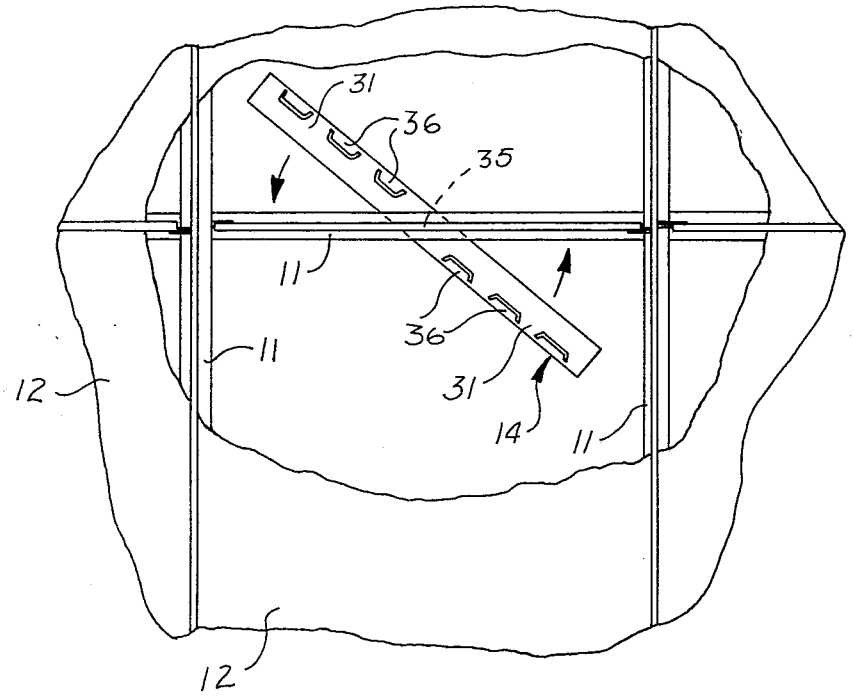
FIG. 2 is a schematic plan view of a converter bracket in an initial assembly position relative to a grid tee selected to carry it.
Figure 5:
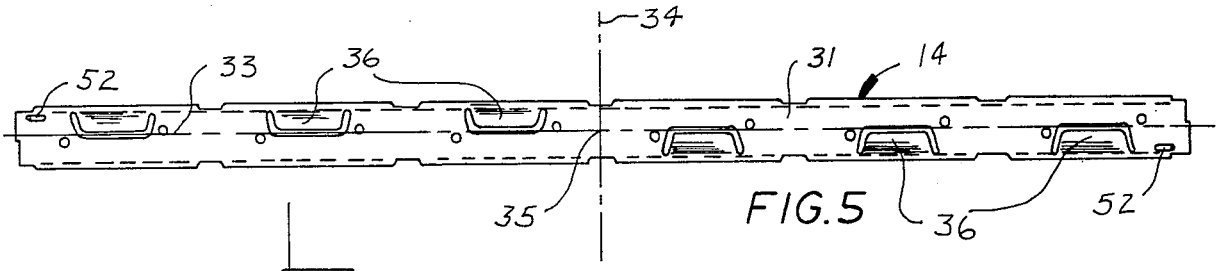
FIG. 5 is a top view of the connector bracket.

As schematically illustrated in FIG. 2, the bracket 14 is secured to a selected tee 11 by approximately centering its midpoint determined by intersection of the axes 33,34 with the center of the span of the selected tee between the adjacent set of crossing tees. With this bracket center of symmetry 35 reasonably centered with the midpoint of the selected tee and with the bracket web 31 in contact with the lower face 19 of the tee flange 16 and with the bracket 14 forming an oblique angle with the selected tee, the bracket is caused to be rotated manually into parallel alignment with the selected tee. The opposed tabs 36 nearest the center of symmetry 35, due to the elevation of their free edges 48 above the plane of the web 31, are caused to slip over and grip against the upper or reverse faces 21 of the tee flange 16. Continued rotation of the bracket 14 beyond the condition illustrated in FIG. 2 into parallel alignment with the selected tee 11 causes the remaining tabs 36 in like manner, by virtue of their free edges 48 and kneelike configuration, to cam over the upper faces 21 of the flanges to thereby secure the bracket 14 to the tee flange 16.

Figure 7:
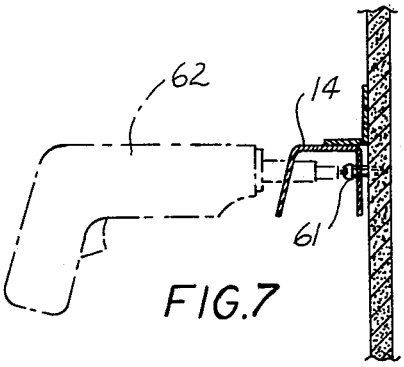
FIG. 7 schematically illustrates a method of attaching the converter bracket to a vertical wall at the edge of a ceiling.

When the bracket 14 is in full parallel alignment with the selected tee 11, the tee flange 16 is pinched or gripped between the tabs 36 on the upper side 21 of the flange and by the remaining surface areas of the web 31 on the lower side 19. It will be understood that where the panels 12 are in place, the tabs 36 extend between the flanges 16 and the marginal areas of such panels. The knee-like configuration of the tabs 36 and an inherent springlike characteristic of the material of such formation allow such tabs to reliably frictionally grip the flange areas of the selected tees. It can be seen that the bracket 14 is thereby secured to the tee 11 without recourse to separate fasteners where desired. At both ends of the bracket 14 there are lanced projections 52, formed in the manner of louvres, which project slightly above the plane of the web 31 and which are adapted to longitudinally index the bracket 14 to the edges of the flanges of the tees crossing the selected tee 11 on which the bracket is being mounted. The abutment of an edge 53 of a lanced projection 52 against the edge of the adjacent crossing tee enables an installer to accurately position the bracket 14 endwise and thereby facilitates accurate positioning of the bracket 14 on the selected tee. The brackets 14 are installed on tees 11 running at right angles to the desired longitudinal direction of the beams 13. Where the beams 13 intersect a wall or similar structure, a bracket can be installed in the manner illustrated in FIG. 7. The flange 32 associated with the relatively small holes 51 is manually bent so that it extends at right angles to the web 31. Screws or like fasteners 61 are positioned in such small holes 51 individually and are driven by a power screwdriver 62 or other tool extending through the larger holes 49 oppositely aligned with the screw holes 51. The brackets 14 are installed on all of the tees running crosswise to the desired beam direction or on spaced ones of the tees running in such crosswise direction.

With the brackets 14 mounted on selected tees in the field of the ceiling system to be converted, installation of linear beams can proceed. The lower bracket tabs 38 are adapted to receive elongated linear beams having a U-channel cross section such as those shown in aforementioned U.S. Pat. No. 4,257,206. The beams 13, which are U-shaped, have reentrant or inturned flanges with projections 67 adapted to snap into the undercut edges 42 of the tabs 38. The undercut areas 42 of the tabs 38, in this manner, grip the beams 13 and support them on the associated tees 11. With the beams 13 in place, the brackets 14 are mechanically interlocked on the selected tees 11. Such interlocking results from engagement of the beams 13 with the bracket tabs 38, which prevents any significant rotation of a bracket about its center of symmetry 35 in the plane of the web 31, which would otherwise allow the upper gripping tabs 36 to disengage from the tee face flange 16.

From the foregoing, it can be understood that the brackets 14 can be installed, followed by the beams 13, with the panels 12 in place. Thus, where an existing tee grid panel ceiling is in place, the bracket 14 not only saves labor and disposal problems associated with removing such pre-existing structure, but also eliminates the time and materials which would otherwise be necessary to erect an entirely new suspension system for the linear beams 13. Advantages of leaving the panels 12 in place include increased sound absorption and heat insulating capacity. Where desired, the panels 12, as well as the lower tee flange faces 19, can be coated with a dark material such as flat black paint to visually hide these elements.

The disclosed bracket 14 in certain instances, particularly when inventories can be reduced and simplified, may be sufficiently economical to use in conjunction with new construction and conventional tees ordinarily used with lay-in panels such as those disclosed at 12.

Although the preferred embodiment of this invention has been shown and described, it should be understood that various modifications and rearrangements of the parts may be resorted to without departing from the scope of the invention as disclosed and claimed herein.

What is claimed is:

1. A method of converting the appearance of a tee grid lay-in panel ceiling structure to that of a linear beam array structure, comprising the steps of providing a plurality of elongated converter brackets each having a nominal length substantially equal to a dimension of the rectangular grid of the tees, providing each bracket with first gripping means adapted to engage the face flange of a parallel aligned tee and second gripping means spaced in a predetermined pattern along its length and adapted to engage a plurality of beams extending crosswise to said bracket, assembling the converter brackets on selected parallel tees in an existing suspended grid by engaging said first gripping means with the face flanges of such selected tees, and assembling a plurality of beams on said converter brackets by interengaging said beams with said second gripping means, said first gripping means preparatory to installation lying in a substantially horizontal plane, and including a first plurality of elements on one longitudinal side of the bracket and second plurality of elements on the other side of the bracket, said first plurality of elements being adapted to engage a face flange exclusively from one side of the web of a tee and said second plurality of elements being adapted to engage a face flange exclusively from the opposite side of the web of the tee, said first gripping means being arranged to interengage with said face flanges while lay-in ceiling panels are disposed on said selected grid tees and others, said converter brackets being installed on said selected tees while said lay-in panels are in place on said selected tees and others, said brackets being provided with camming means and being mounted on said face flange by engaging said face flange substantially at the middle of said bracket while said bracket extends at an angle with respect to said face flange and thereafter rotating said brackets into alignment with said face flange causing said first and second plurality of elements to move into engagement with said face flange, and camming said brackets axially with respect to said grid tees in response to said rotation thereof to properly position brackets with respect to each other along said face flange.

2. A bracket method set forth in claim 1 wherein said camming means are adapted to engage cross tees to provide said camming action.

3. A bracket method as set forth in claim 1 wherein said brackets provide laterally spaced second gripping elements operable to engage said channel shaped beams at longitudinally spaced locations therealong to prevent said counter rotation of said brackets.

4. In a building, a plurality of elongated, inverted tees running in two perpendicular, horizontal directions in a common plane and intersecting to form a rectangular grid, said tees being suspended from an overhead superstructure, a plurality of brackets gripping the lower flange portion of selected tees running in one direction, said brackets being substantially coextensive in length with such selected tees, each bracket having first gripping means engaging the flange of its associated selected tee, said first gripping means securing its respective bracket to the associated selected tee, each bracket including second gripping means below said first gripping means, said second gripping means being spaced in a predetermined pattern lengthwise of the bracket, a plurality of elongated beams supported by said grid tees through said brackets, said second gripping means being arranged to hold said beams in parallel alignment crosswise of said selected tees and spaced in said predetermined pattern, said beams interengaging and coacting with said brackets in a manner which prevents separation of said first gripping means from the flanges of said selected tees said first gripping means of a bracket being engaged with an associated flange by rotation of said bracket in a plane parallel to the plane of the grid, said beams when installed on said bracket preventing counter-rotation of said bracket and disengagement of said first gripping means from the associated flange, said brackets providing camming means operable to axially position said brackets relative to each other in response to said rotation of said brackets.

5. In a building structure as set forth in claim 4 wherein said second gripping means of each bracket engage said beams at axially spaced locations along said beams to prevent said counter rotation of said brackets.

* * * * *